US005721376A

United States Patent [19]

Pavone et al.

[11] Patent Number: 5,721,376

[45] Date of Patent: Feb. 24, 1998

[54] METHOD AND SYSTEM FOR PREDICTING THE APPEARANCE OF A DYSFUNCTIONING DURING DRILLING

[75] Inventors: Didier Pavone, Eaubonne; Christophe Vignat, Paris; David Brunet, Champs sur Marne, all of France

[73] Assignee: Institut Francais du Petrole, Rueil-Malmaison, France

[21] Appl. No.: 626,264

[22] Filed: Apr. 1, 1996

[30] Foreign Application Priority Data

Mar. 31, 1995 [FR] France ..... 95 03930

[51] Int. Cl.[6] ..... E21B 47/00; E21B 44/00

[52] U.S. Cl. ..... 73/152.47; 175/40

[58] Field of Search ..... 73/152.47, 152.48, 73/152.49, 152.58, 152.59; 364/420; 175/40, 56

[56] References Cited

U.S. PATENT DOCUMENTS

| | | | |
|---|---|---|---|
| Re. 28,436 | 6/1975 | Vitter, Jr. et al. | 73/151 |
| 3,703,096 | 11/1972 | Vitter, Jr. et al. | 73/151 |
| 4,250,758 | 2/1981 | Pitts, Jr. et al. | 73/650 |
| 4,715,451 | 12/1987 | Bseisu et al. | 73/152.49 X |
| 5,321,981 | 6/1994 | Macpherson | 73/152.58 X |
| 5,358,059 | 10/1994 | Ho | 175/45 |
| 5,448,911 | 9/1995 | Mason | 73/152.47 |
| 5,550,788 | 8/1996 | Pavone et al. | 367/25 |

FOREIGN PATENT DOCUMENTS

| | | |
|---|---|---|
| 0 209 343 | 1/1987 | European Pat. Off. . |
| 0 218 328 | 4/1987 | European Pat. Off. . |
| 2 688 026 | 9/1993 | France . |
| 94/19579 | 9/1994 | WIPO . |

OTHER PUBLICATIONS

Keith Rappold, "Drillstring vibration measurements detect bit stick–slip", *Oil& Gas Journal*, 91:9, pp. 66–70, Mar. 1993.

*Primary Examiner*—Michael Brock

*Attorney, Agent, or Firm*—Millen, White, Zelano, & Branigan, P.C.

[57] ABSTRACT

In a method and to a system suited for monitoring the behaviour of a drill bit (2), the damping associated with a natural mode of the torsional oscillations measured by at least one measuring device (4) placed in the drill string is determined. The appearance of a stick-slip type dysfunctioning is predicted when the damping value decreases significantly as a function of time, and drilling parameters are then varied in order to avoid the appearance of the dysfunctioning.

4 Claims, 4 Drawing Sheets

METHOD AND SYSTEM FOR PREDICTING THE APPEARANCE OF A DYSFUNCTIONING DURING DRILLING

FIELD OF THE INVENTION

The present invention relates to a method and to a system suited for monitoring a dysfunctioning in the behaviour of a drill bit driven into rotation by means of a drill string. This dysfunctioning is commonly referred to as "stick-slip". The present invention notably allows to provide means enabling to predict the appearance of the dysfunctioning, which allows to act upon different drilling parameters so as to prevent the real start of the stick-slip motion.

The stick-slip behaviour is well-known to drill men and it is characterized by very substantial variations in the rotating speed of the drill bit as it is driven by means of a drill string brought into rotation from the surface at a substantially constant speed. The bit speed can range between a value that is practically zero and a value that is much higher than the rotating speed applied at the surface to the string. This can notably result in harmful effects on the life of the drill bits, and increase the mechanical fatigue of the drillpipe string and the frequency of connection breakages.

BACKGROUND OF THE INVENTION

The article "Detection and monitoring of the stick-slip motion: field experiments" by M. P. Dufeyte and H. Henneuse (SPE/IADC 21945—Drilling Conference, Amsterdam, 11–14 Mar. 1991) describes an analysis of the so-called "stick-slip" behaviour from measurements performed with a device placed at the upper end of the drill string. If a stick-slip type dysfunctioning appears, this document recommends either to increase the rotating speed of the drill string from the rotary table, or to decrease the weight on bit by acting upon the drawworks.

The article "A study of stick-slip motion of the bit" by Kyllingstad A. and Halsey G. W. (SPE 16659, 62nd Annual Technical Conference and Exhibition, Dallas, Sept. 27–30, 1987) analyzes the behaviour of a drill bit by using a pendular model.

The article "The Genesis of Bit-Induced Torsional Drillstring Vibrations" by J. F. Brett (SPE/IADC 21943—Drilling Conference, Amsterdam, 11–14 Mar. 1991) also describes the torsional vibrations created by a PDC type bit.

However, although different methods have already been formulated in the profession in order to try to stop the stick-slip phenomenon, no solution has been provided to predict and to prevent the appearance of the phenomenon.

SUMMARY OF THE INVENTION

The present invention thus relates to a drilling optimization method allowing to predict a stick-slip type dysfunctioning, wherein drilling means include a bit fastened to the lower end of a drill string driven into rotation from the surface and at least one device including means for measuring in real time the torsional oscillations of said string. In this method, the damping associated with at least one low-frequency natural mode of said oscillations is identified as a function of time and at least one drilling parameter is varied as soon as a significant decrease in the value of said damping appears.

A linear transfer function can be determined between the bottomhole torsion signals and the surface torsion signals, and the damping associated with the natural modes of lower frequency can be calculated.

The damping associated with a pole of the transfer function can be calculated from the formula as follows:

$$\mu=\mathrm{Log}(1/P)[m^2+\mathrm{Log}^2(1/P)]^{1/2}$$

where P is the module of the pole and m is the phase of the pole.

The bottomhole and the surface torque signals can be measured in real time and a transfer function corresponding to an autoregressive moving average model (ARMA) can be determined in real time.

The invention also relates to a drilling optimization system allowing a stick-slip type dysfunctioning to be predicted, wherein drilling means include a bit fastened to the lower end of a drill string driven into rotation from the surface and at least one device including means for measuring in real time the torsional oscillations of said string. The system comprises means for calculating, as a function of time, the damping associated with at least one low-frequency natural mode of said oscillations and means for monitoring the appearance of a significant decrease in the value of said damping.

The system can include means for measuring the torsional oscillations downhole and at the surface, with respect to the string, and means for determining a transfer function between the bottomhole and the surface.

BRIEF DESCRIPTION OF THE DRAWINGS

Other features and advantages of the invention will be clear from reading the description hereafter of non limitative examples, with reference to the accompanying drawings in which.

DESCRIPTION OF THE PREFERRED EMBODIMENTS

Figure 1:
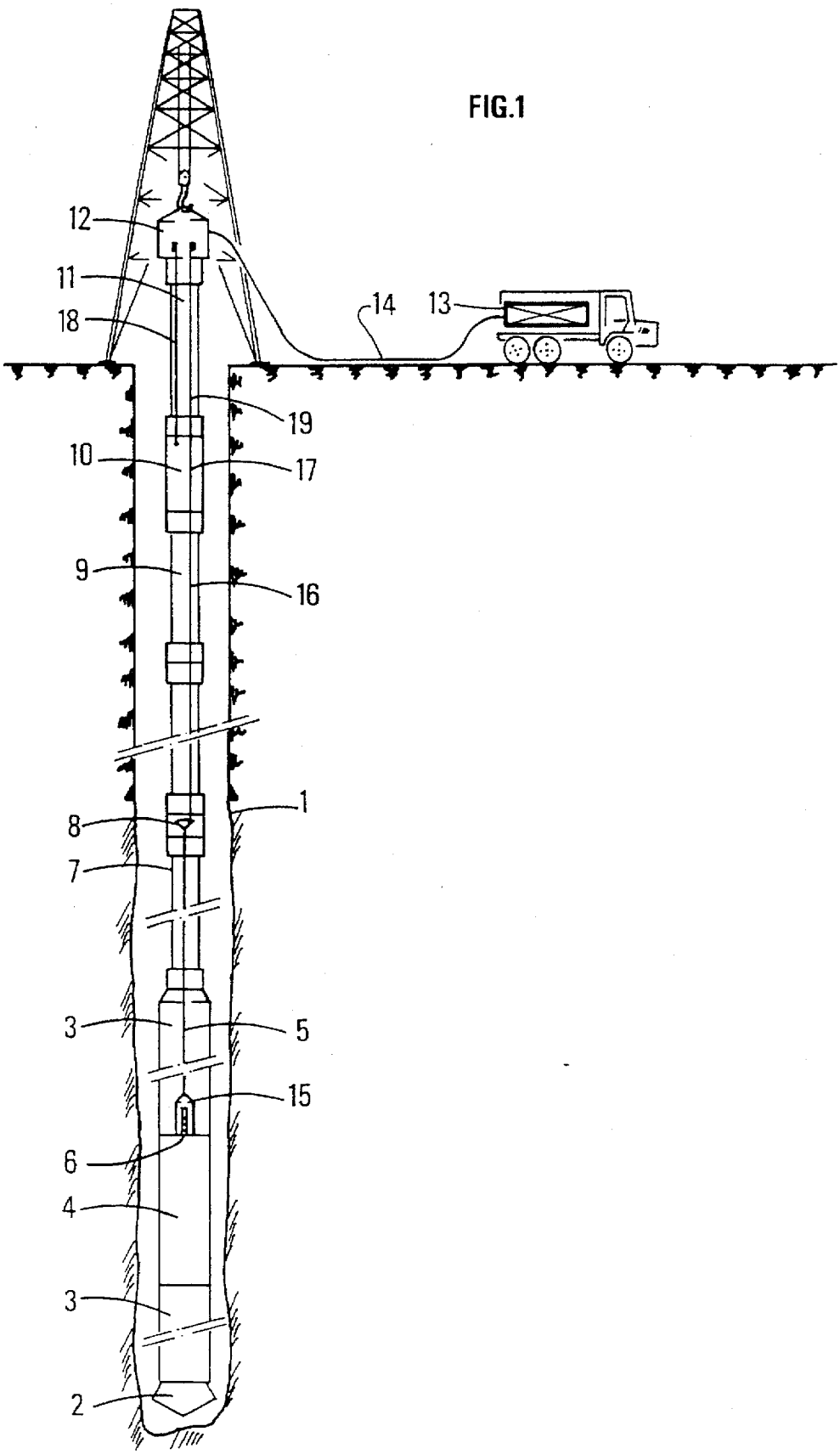
FIG. 1 shows a system allowing the invention to be implemented.

In FIG. 1, reference number 2 refers to the drill bit lowered into well 1 by means of the drill string. Conventional drill collars 3 are screwed on above the bit. A first measuring means is made up of a sub 4, generally placed above bit 2 where measurements near to the bit are more interesting, notably in order to follow the dynamic of the bit. However, it can also be placed within or at the top of the drill collars, or even at the level of the drill pipes.

The drill string is completed by conventional pipes 7 up to the suspension and connection sub 8. Above this sub, the drill string is lengthened by adding cabled pipes 9.

Cabled pipes 9 are not described in this document since they are well-known from the prior art, notably through patents FR-2,530,876, U.S. Pat. No. 4,806,115 or patent application FR-2,656,747.

A second measuring means placed in a sub 10 is screwed below kelly 11, the cabled pipes being then added below this sub 10. A rotary electric connection 12 placed above kelly 11 is electrically connected to the surface installation 13 by a cable 14.

When the drill rig is provided with a power swivel, there is no kelly and measuring sub 10 is screwed on directly below rotary connection 12, which is located below the power swivel.

Measuring sub 4 includes a male connector 6 whose contacts are linked to the measuring sensors and to the associated electronics included in sub 4.

A cable 5 equivalent to a wireline logging cable comprises, at its lower end, a female connector 15 suited for co-operating with connector 6. The upper end of cable 5 is suspended from sub 8. Sub 8 is suited for suspending the cable length 5 and for connecting electrically the conductor or conductors of cable 5 to the electric link or links of the cabled pipe placed immediately above. The electric link provided by the cabled pipes bears reference number 16. This electric link passes through 17 in the second measuring sub 10.

When a kelly 11 is used, it is also cabled and includes two electric cables 18 and 19. One cable, 18, connects the second sub 10 to the rotary contacts of rotary connection 12, and the other, 19, connects line 17 to other rotary contacts of connection 12.

The surface cable 14 can include at least six conductors.

Sub 4 is generally connected by a single conductor to the surface installation 13. The measurements and the power supply pass through the same line.

The measuring means of sub 4 preferably comprises sensors for measuring, alone or in combination:

the weight on bit, the reactive torque about the drill bit, the bending moments along two orthogonal planes, the accelerations along three orthogonal axes, one of them merging in the longitudinal axis of the drill string, the temperatures and the pressures inside and outside the string, the rotation acceleration, the components of the magnetic field.

The first three measurements can be obtained through strain gages stuck onto a test cylinder. They are protected from the pressure by an appropriate housing. The design and the build-up of this housing are suited for substantially preventing measuring errors due to efficiencies.

Accelerations are measured by two accelerometers per axis in order to check errors induced by the rotation dynamics.

The last set of measurements is obtained by specific sensors mounted in a separate part of the sub.

The orders of magnitude of the mechanical characteristics of the first sub 4 are for example as follows:

outside diameter: 20.3 cm (8 to 8.25 inches), length: 9 m, tensile/compressive strength: 150 tf, torsional strength: 4000 m.daN, bending strength: 7500 m.daN, internal and external pressure: 75 MPa, temperature: 80° C.

The second measuring means of measuring sub 10 preferably includes, alone or in combination, sensors for measuring:

the tension, the torsion, the axial acceleration, the internal pressure or pump pressure, the rotation acceleration.

The design of this surface sub 10 is not basically different from that of the first sub, apart from the obligation to leave a free mud passage substantially coaxial to the inner space of the string so as to allow, if need be, transfer of a bit inside the string.

The orders of magnitude of the mechanical characteristics of the second sub 10 are for example as follows:

outside diameter: 20.3 cm (8 to 8.25 inches), length: 1.5 m (5 feet), tensile strength: 350 tf, torsional strength: 7000 m.daN, internal/external pressure: 75/50 MPa.

In a variant of the acquisition system according to the embodiment of FIG. 1, a high measurement transmission frequency is obtained by means of electric links made up of cable 5, line 16 and 17, and surface cable 14.

Such an acquisition system is described in document FR-2,688,026.

Figure 2:
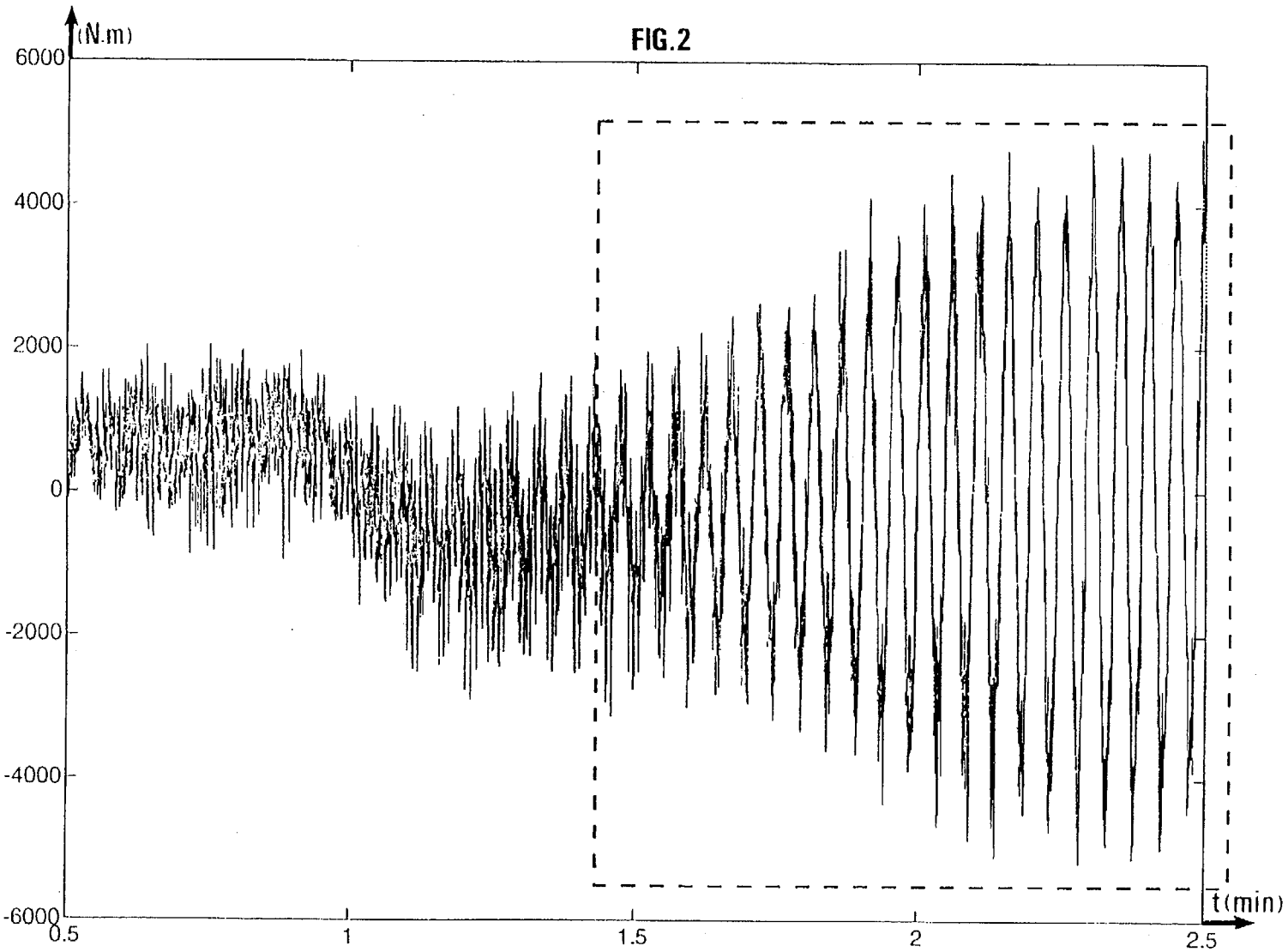
FIG. 2 shows a surface record of a torque signal as a function of time.

FIG. 2 shows a torque signal recorded by surface sub 10. The recording time is two minutes, from 0.5 to 2.5 mn, laid off as abscissa. The amplitude of the oscillations, laid off as ordinate, is expressed in N.m. The signal portion represented comprises, from the abscissa zone 1.5, a zone of strong oscillations corresponding to a dysfunctioning of the stick-slip type. The previous zone corresponds to a trouble-free running.

The object of the invention is to calculate the damping factor associated with the fast natural mode relative to the stick-slip. To that effect, a transfer function is identified between the bottomhole signals and the surface signals, such as the bottomhole torque measured with bottomhole sub 4 and the surface torque measured with surface sub 10.

Autoregressive moving average models (ARMA), that are well-known and that can be characterized by the equations as follows, are used:

$$x(t) = -\sum_{k=1}^{p} a_k \cdot x(t-kT) + \sum_{k=0}^{q} b_k \cdot u(t-kT-nT) + e(t)$$

where x(t) is the output signal, u(t) the input signal and e(t) a white noise.

Autoregressive models are described in the following books:

"System Identification Toolbox User's Guide", July 1991, The Math Works Inc., Cochituate Place, 24 Prime Park Way, Natick, Mass. 01760.

"System Identification—Theory for the User" by Lennart LJUNG, Prentice-Hall, Englewood Cliffs, N.J., 1987.

"Digital Spectral Analysis with Applications" by S. Lawrence MARPLE Jr., Prentice-Hall, Englewood Cliffs, N.J., 1987.

"Digital Signal Processing" by R. A. ROBERTS and C. T. MULLIS, Addison-Wosley Publishing Company, 1987.

For the identification of an autoregressive model, the most delicate stage consists in determining its orders (p,q), i.e. the number of coefficients of the model. In fact, if the order selected is too small, the model cannot express all the modes of vibration. Conversely, if the order selected for the model is too great, the transfer function obtained has more natural modes than the system, and errors can thus result therefrom. A modeling error can be significant.

The delay nT reveals the transfer time of a signal through the drill string. The transmission rate of the shear waves is about 3000 m/s. Consequently, knowing the length of the drill string during the recording, the delay nT can be automatically determined. For example, during the acquisition of the signal shown in FIG. 2, the length of the string was about 1030 m, which gives a delay nT of 0.34 s,i.e. about n=15 values for a sampling of the data at 45 Hz.

Determination of p: Tests have been carried out in order to determine the parameter p that characterizes the number of poles of the transfer function. In order to get an idea of the value of p, a spectral study of the signals has been carried out to determine the number of frequency peaks with phase change, that is associated with the number of natural modes. This allows to get an idea of the order of magnitude of p, knowing that two conjugate complex poles correspond to each natural mode and therefore that p is equal to double the number of natural modes. At the end of this first approximation, the value of p ranges between 24 and 36.

After a series of tests on different torque signals, the optimum determination of p is 26.

In order to determine the parameter q, it is increased from the value 1 until an optimum representative model is obtained. The real surface signals have thus been compared with those obtained with the transfer function from the bottomhole signals recorded by bottomhole sub 4. It turned out that q=1 is sufficient.

In the case of autoregressive models, the polynomial $$A(z) = 1 + \sum_{k=1}^{p} a_k \cdot Z^{-k}$$

constitutes the denominator of the transfer function obtained. Consequently, if the zeros of this polynomial are determined, one obtains the poles of the transfer function that is associated with the natural modes of the system.

Figure 3:
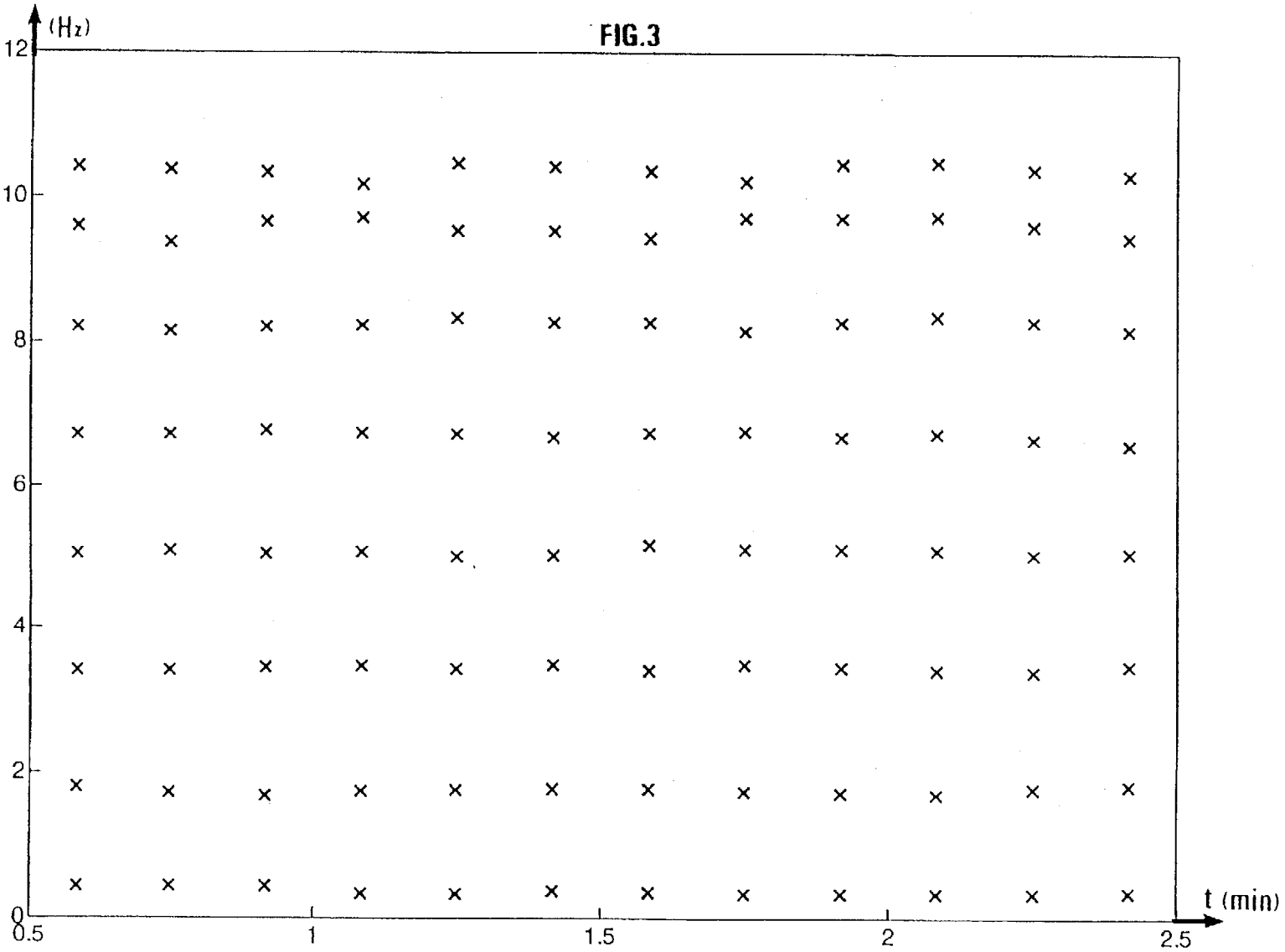
FIG. 3 shows the calculation of the frequencies of the natural modes of the torque signal within the same time interval.

FIG. 3 shows the evolution of the natural modes of the signal of FIG. 2 as a function of time laid off as abscissa, the frequencies in Hertz being laid off as ordinate. The natural modes are calculated here according to the principle expounded above. The stability of the natural modes represented by a cross demonstrates the existence of an invariant linear transfer function between the bottomhole and the surface as regards the twisting moment.

As for the calculation of the dampings μ related to the natural modes, the following formula has been used:

$$\mu = \mathrm{Log}(1/P)/[m^{2+Log^2}(1/P)]^{1/2}$$

where P is the module of the pole and m the phase of the pole corresponding to the natural mode.

Figure 4:
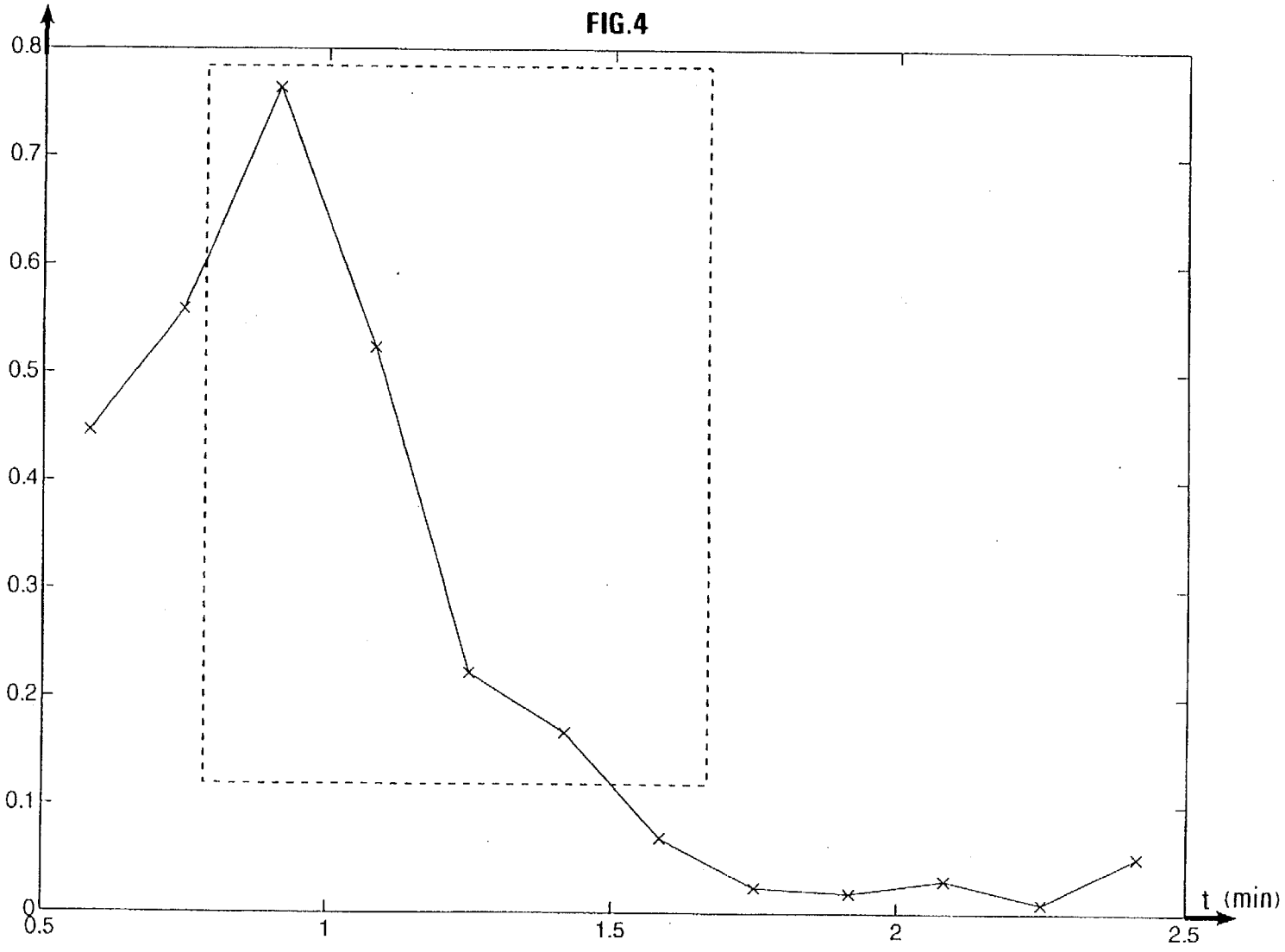
FIG. 4 shows the evolution, within the same time interval, of the damping factor associated with the first natural mode (0.3 Hz here) when the stick-slip type dysfunctioning appears.

FIG. 4 shows the evolution as a function of time of the damping of the first natural mode, i.e. 0.3 Hz, which is related to the stick-slip type dysfunctioning that causes the strong oscillations of the torque from the time 1.5 in FIG. 2. It may be observed that, at the time 1.5, the damping has undergone a strong decrease that correlatively generates the stick-slip motion.

It is therefore possible to predict the start of the stick-slip by carrying out a real time calculation of the damping value of the natural mode associated with the stick-slip. In our example, it is the first natural mode, but it is obvious that in other examples relative to another system it could be another mode than the first mode, for example the second or even the third. However, it is experimentally recognized that only the first natural modes can be associated with the stick-slip type dysfunctioning.

A system allowing to calculate the damping in real time from the surface torque signals and possibly from the bottomhole torque signals thus allows to predict the start of the stick-slip motion through the real time analysis of the evolution of the damping value. The means for calculating and for determining a transfer function are preferably placed in the surface installation 13 (FIG. 1 ). When the damping reaches a low value within the space of several ten seconds, the operator can be alerted by an alarm and correct drilling parameters so as to prevent stick-slip. The drilling parameters can be the weight on bit, the rotating speed, the friction torque on the walls of the well when a remote-controlled device is integrated in the drill string.

We claim:

1. A drilling optimization method allowing to predict a dysfunctioning of the stick-slip type, wherein drilling means include a bit fastened to the lower end of a drill string driven into rotation from the surface, and at least one device including means for measuring in real time the torsional oscillations of said string, characterized in that the damping associated with at least one low-frequency natural mode of said oscillations is identified as a function of time, in that at least one drilling parameter is varied as soon as a significant decrease in the value of said damping appears, in that a linear transfer function is determined between the bottomhole torsional oscillations and the surface torsional oscillations, and in that the damping associated with the at least one natural mode of lower frequency is calculated.

2. A method as claimed in claim 1, characterized in that the damping associated with a pole of the linear transfer function is calculated from formula as follows:

$$\mu = \mathrm{Log}(1/P)/[m^2 + \mathrm{Log}^2(1/P)]^{1/2}$$

where P is the module of the pole and m is the phase of the pole.

3. A method as claimed in claim 1, characterized in that the torsional oscillation are measured in real time downhole and at the surface, and in that a transfer function corresponding to an autoregressive moving average model (ARMA) is determined.

4. A drilling optimization system allowing to predict a dysfunctioning of the stick-slip type, wherein drilling means include a bit (2) fastened to the lower end of a drill string driven into rotation from the surface, and at least one device (4) including means for measuring in real time the torsional oscillations of said string, characterized in that it comprises means for measuring the torsional oscillations downhole and at the surface, with respect to the string, and means for determining a linear transfer function between the bottomhole and the surface, means for calculating as a function of time the damping associated with at least one low-frequency natural mode of said oscillations and means for monitoring the appearance of a significant decrease in the value of said damping.

* * * * *